United States Patent [19]

Moudry et al.

[11] 3,976,234

[45] Aug. 24, 1976

[54] PORTABLE SKI AND SKI POLE CARRYING APPARATUS

[75] Inventors: George M. Moudry; Nancy Lee Moudry, both of Naperville; Nicholas F. Casiello, Lisle; Anthony V. Marino, Lombard, all of Ill.

[73] Assignee: Amphora Enterprises Inc., Lisle, Ill.

[22] Filed: Sept. 23, 1974

[21] Appl. No.: 508,460

[52] U.S. Cl. ..... 224/45 S; 280/11.37 K; 24/81 SK

[51] Int. Cl.[2] ..... B65D 71/00

[58] Field of Search ..... 224/45 S, 45 Q, 45 P, 224/58, 28 D, 5 E; 280/11.37 K, 11.37 A; 24/81 SK, 81 CC, 201 A

[56] References Cited

UNITED STATES PATENTS

| | | | |
|---|---|---|---|
| 613,902 | 11/1898 | Grace | 24/201 A |
| 1,701,057 | 2/1929 | Thatcher | 224/28 D |
| 1,810,027 | 6/1931 | Moran et al. | 24/201 A |
| 3,091,011 | 5/1963 | Campbell | 280/11.37 K |
| 3,251,069 | 5/1966 | Clark | 24/81 CC |
| 3,626,553 | 12/1971 | Darney et al. | 224/45 S |

FOREIGN PATENTS OR APPLICATIONS

| | | | |
|---|---|---|---|
| 570,654 | 2/1933 | Finland | 280/11.37 K |
| 189,977 | 2/1954 | Germany | 280/11.37 A |

*Primary Examiner*—L. J. Paperner
*Assistant Examiner*—Kenneth Noland
*Attorney, Agent, or Firm*—Robert E. Browne

[57] ABSTRACT

A lightweight, portable apparatus for carrying skis and ski poles having a relatively rigid body member formed of a lightweight, easily molded material having one end formed with generally C-shaped clips to receive and hold a pair of parallel ski poles. One end of an elongated elastic strap is mounted on the body member to encircle a pair of parallel skis. The opposite end of the strap has locking means which engage the body member to maintain the elastic strap in tension around the skis and hold them tightly and securely together.

12 Claims, 8 Drawing Figures

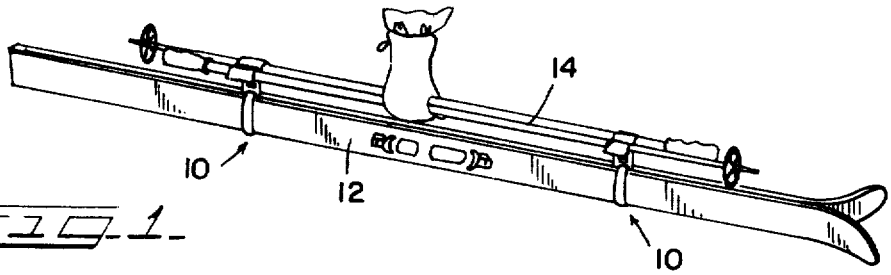
FIG. 1
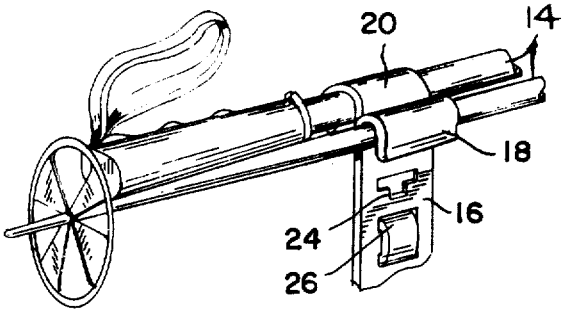
FIG. 2
FIG. 5
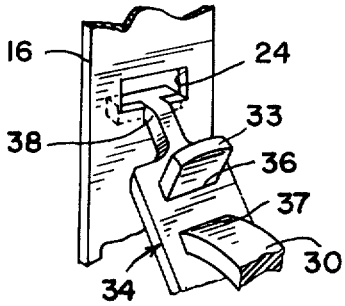
FIG. 3
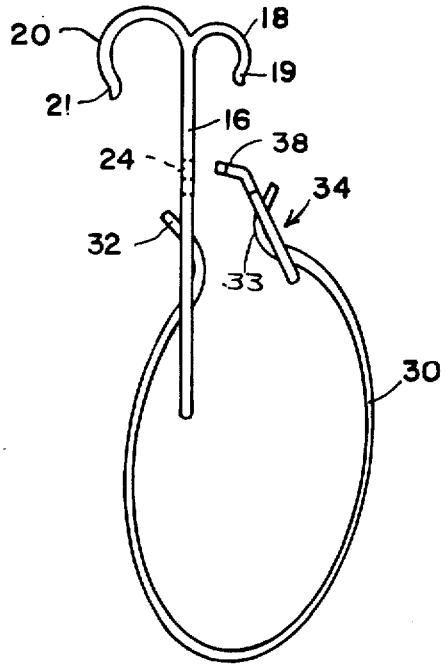
FIG. 4
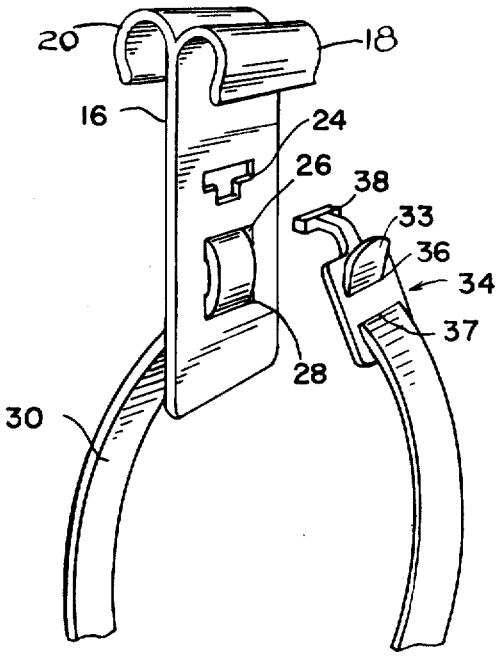

PORTABLE SKI AND SKI POLE CARRYING APPARATUS

BACKGROUND OF THE INVENTION

This invention relates to carrying apparatus which permits an individual to hand carry his own ski equipment.

Many devices have been designed and are presently available which allow an individual skier to attempt to hand carry his ski equipment. The need for such a device is created by the obvious difficulty in carrying a pair of long, cumbersome skis and ski poles, even short distances, without any means for holding them together securely and compactly. Most of these devices, however, are in themselves heavy and bulky, having handles and cross braces, and/or are costly to manufacture, requiring a number of complementary and engaging mechanical parts such as latches. Such parts not only increase the cost of such a device to the skier but also increase the possibility of breakage. Other simpler carrying devices, such as those formed by leather or rubber with straps having holes formed in their ends to receive the poles and skis, require an excessive amount of time to put on or remove from the skis and poles since their flexibility makes them difficult to manipulate.

SUMMARY OF THE INVENTION

The present invention provides a simple, durable, inexpensively manufactured and easy to use portable ski and ski pole carrier which provides a positive means of mounting ski poles in parallel relationship with one another and with a pair of skis for hand transport. This invention solves the problems of the prior art, eliminating complex latches, metal parts and bulky handles by mounting the ski poles on a pair of small rigid body members and attaching the skis adjacent one another and to the body member by an elastic strap so that the poles themselves serve as a handle for carrying the skis.

This invention includes a simple, easily formed, relatively rigid body member which may be molded from any durable temperature-resistant plastic material. This body member is formed with a pair of opposite ears or clips at one end thereof, which receive the ends of standard sized ski poles in spring engagement therewithin. A strong, light-weight elongated elastic strap has one end mounted near the opposite end of the body member. This strap may then be looped and stretched around a pair of skis placed bottom to bottom adjacent one another and the opposite end of the strap attached by complementary locking means to the rigid body member. The free end of the strap may be attached to the body member by means of either a T-shaped locking tab mounted adjustably near the free end of the strap which engages a corresponding opening in the body member or by means of spaced holes formed in the strap which may be placed over a locking tongue formed in the body member.

It is easily seen that the present invention is extremely light in weight, involves no moving mechanical parts which may tend to break or corrode and is easy and inexpensive to manufacture by molding from a single piece of plastic. Despite its simplicity in manufacture, it is extremely strong and durable and is adjustable to fit various ski dimensions. Unlike many of these ski carrying devices presently on the market, this invention may be placed in the pocket of a ski jacket when not in use.

Accordingly, it is an object of the present invention to provide a portable apparatus for mounting ski poles and skis relative to one another for hand carrying.

It is also an object of the present invention to provide an improved portable ski and ski pole carrying apparatus which effectively maintains the poles and skis in a secure relationship, is light in weight, occupies a minimal amount of space, is durable and is extremely inexpensive to manufacture.

It is a further object of the present invention to provide an apparatus for positively and rigidly mounting a pair of ski poles adjacent one another and a pair of skis in relationship thereto such that the ski poles serve as a handle for carrying the skis.

It is one more object of the present invention to provide an apparatus for carrying skis and ski poles in which the means for mounting the skis is adjustable to assure that the skis are mounted securely.

These and other objects of the present invention will become apparent from the following description taken in conjunction with the drawings wherein:

FIG. 1 is a perspective view showing the ski pole and ski carrying apparatus of the present invention in actual use;

FIG. 2 is a partial perspective view of the ski pole and ski carrying apparatus of the present invention shown holding ski poles of tapered design;

FIG. 3 is a side elevational view of the ski and ski pole carrying apparatus of the present invention shown in FIG. 1;

FIG. 4 is a perspective view of the ski and ski pole carrying apparatus of the present invention shown in FIG. 1;

FIG. 5 is a slightly enlarged partial cut-away view of the ski and ski pole carrying apparatus of the present invention, showing one embodiment of the complementary means for securing the free end of the elastic strap to the body member;

FIG. 6 is a partial cut-away front elevational view of the ski and ski pole carrying apparatus of the present invention showing a second embodiment of the complementary means for securing the free end of the elastic strap to the body member;

FIG. 7 is a cut-away front elevational view of the ski and ski pole carrying apparatus of the present invention showing a third embodiment of the complementary means for securing the free end of the elastic strap to the body member; and, FIG. 8 is a side elevational view of the ski and ski pole carrying apparatus of the present invention showing an alternate means for mounting one end of the elastic strap on the body member.

DESCRIPTION OF THE DRAWINGS

Referring now to the drawings and, in particular to FIG. 1, the portable hand ski and ski pole carrying apparatus of the present invention is shown in general at 10, as used in a pair in spaced relation for securely holding a pair of adjacent poles 14 and skis 12 for carrying. The portable carrying apparatus 10 is shown in greater detail in FIGS. 3 and 4, and includes a relatively rigid body member 16, which may be formed from any suitable durable, temperature-resistant material, but preferably a plastic such as nylon, which can be easily and inexpensively molded into the desired configuration. The rigidity of this member assures that the ski poles 14, which will be held in a fashion explained below, are positively and securely held near their opposite ends, so that they form a relatively rigid handle member for carrying the heavier skis 12, as shown in FIG. 1.

The upper portion of the integral body member 16 is formed into a pair of resilient or spring clips 18 and 20, which extend outwardly and oppositely from the central vertical axis of the body member like C-shaped ears or petals. In the embodiment shown in FIG. 3, the clip 18, which will engage the tip of a tapered ski pole, has a smaller diameter than the clip 20, which will engage the handle end of the adjacent tapered ski pole. Since ski poles are normally formed with either a standard constant diameter or a standard taper, clips 18 and 20 can be easily formed, during manufacture, with either similar diameters, or with diverse diameters, as shown. In any event, the diameters of clips 18 and 20 correspond to the diameters of the tip and handle ends of the ski poles, respectively, and the clips open downwardly so that upward movement of the pole, once engaged, is prevented. The diameters at the mouths or openings 19 and 21 of clips 18 and 20, however, are reduced so that they are effectively less than the interior diameter of the clip and the exterior diameter of the corresponding end of the ski pole. Thus, the poles must be forced upwardly into engagement within the clips, but are thereafter held positively so that they will not come loose. One of the inherent properties of a plastic material such as nylon is its slight resiliency, which allows the ends 19 and 21 of clips 18 and 20 to be forced outwardly a sufficient distance to permit the pole ends to enter the clips and then to return to engage the poles.

As shown in FIGS. 3 and 4, near the opposite, lower end of the body member 16 may be formed two parallel, generally horizontal slots, an upper slot 26 and a lower slot 28. A first end 32 of an elongated elastic strap 30 formed of a suitable material, such as rubber, is threaded through the slots 26 and 28 in the manner shown in FIGS. 3 and 4. First end 32 of strap 30 may also be formed with an upwardly protruding nib 46 thereon, shown in FIG. 6. This nib 46 may be forced through a single slot 48 during manufacture, and thereby anchor the first end 32' of the elastic strap 30' to the body member 16'. This alternative construction, as shown in FIG. 6, would eliminate one of slots 26 or 28, shown in FIG. 4, and thereby reduce the cost of manufacture.

Figure 6:
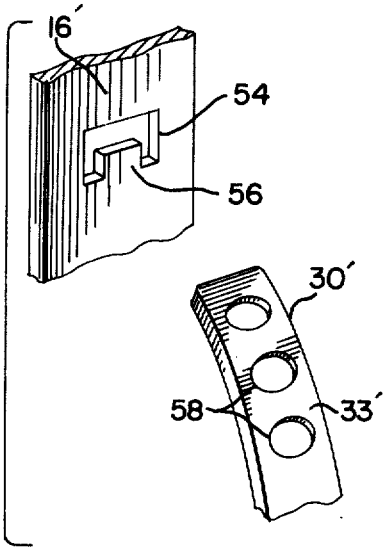
Figure 7:
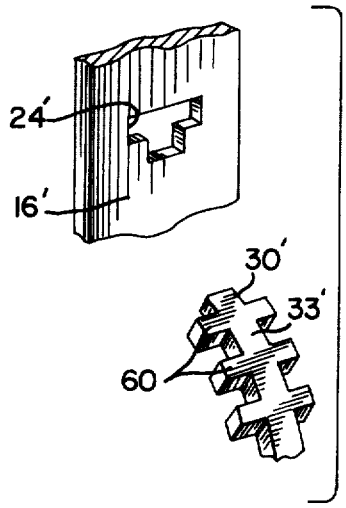
Figure 8:
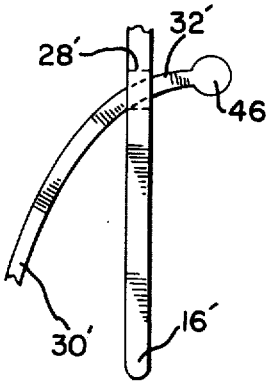

The second end 33 of strap 30 may be, as shown in FIGS. 3–5, threaded through slots 36 and 37 formed in a mounting portion 40 of a locking key 34. This locking key 34 has a T-shaped tab portion 38. This tab 38 fits into a correspondingly T-shaped opening 24 formed in a central portion of body member 16 during manufacture. When tab 38 is inserted through opening 24 and moved downwardly into the neck of the T-shaped opening, it engages the opposite side of the body member 16 and thereby securely locks the second end 33 of strap 30 into position.

In the slightly modified embodiment of this invention shown in FIG. 6, in which prime numerals denote parts similar to those shown in FIGS. 3–5, an opening 54 is formed in a central portion of the body member 16' and has a generally vertical boss or tongue 56 extending upwardly into it. The second end 33' of the strap 30' has a series of spaced holes 58 formed along its length near end 33'. The second end 33' of the strap 30' may be inserted through the opening 54 until the desired tension on the skis is obtained and one of the holes 58 in the strap 30 aligned with and inserted over boss 56 to secure the elastic strap 30' at that tension. This embodiment eliminates the necessity of forming the locking tab 34, shown in FIGS. 3–5, and therefore reduces the manufacturing cost of the present invention.

The means for engaging the body member 16 with the free end 33 of strap 30 could also include a series of outwardly extending ribs or flanges formed along the end 33 of strap 30 during its manufacture. The strap could then be pulled through a locking opening, such as 24, formed in the body member, a desired distance to achieve proper tension and the strap flange adjacent the opposite side of body member 16 allowed to engage the body member to secure the strap thereto.

In operation, the ski and ski pole carrying apparatus 10 of this invention are used in a pair in conjunction with a pair of ski poles, as shown in FIG. 1. Unlike much of the prior art, it is immaterial whether the skis or the poles are attached to the apparatus 10 first. The skis 12 may be placed with their bottoms facing, as shown in FIG. 1, on opposite sides of the body member 16. The elastic strap 30 is then looped around both skis and its tension adjusted by sliding strap 30 through the spaced slots 36 and 37 in locking key 34 and then inserting the tab 38 into the opening 34, or by inserting a hole 58 in the strap 30' over the boss 56 in opening 54, according to the construction used, to achieve the strap tension desired. The body member 16 will keep the ski bottoms slightly spaced to avoid damaging contact, and, since one ski is mounted on either side of the body member 16, the forces exerted on each ski will be approximately the same so they will not slip or slide relative to one another.

In the use of the locking key 34, shown in FIGS. 3–5, it is noted that the body portion 35 of the key 34 is disposed at an angle of the range of 45° to 90° relative to the horizontal plane of the T-shaped tab 38 so that after tab 38 is inserted through the opening 29, the tension exerted on the elastic strap 30 will be such that the body portion 36 of key 34 is disposed generally parallel to the body member 16, with the opposite ends of strap 30 touching each other very nearly at a common point. Thus, the forces exerted on each ski by the strap 30 will be generally uniform, and excessive wear on both the strap and the skis and the slipping of the skis relative to one another will be prevented. Likewise, in the embodiment shown in FIG. 6, opening 54 may be moved downwardly toward the slot 28' through which the first end of the elastic strap 30' is inserted, to achieve a similar uniform force advantage. Once the skis have been mounted by adjusting the tension as desired and attaching strap 30 to body member 16 to hold the skis securely, the poles 14 can be simply sprung into position into the clips 18 and 20, as described above. The poles then serve as a rigid handle for easily carrying the skis.

The present invention can be easily and quickly removed from the skis and ski poles and inserted completely into the pocket of a jacket or the like without difficulty or discomfort. It is contemplated that the unique design and construction of the present invention can be manufactured at less than half the cost of most presently available equipment carriers and permit a significant reduction in the sale price while performing the same function in a substantially better manner.

While the present invention has been discussed in relation to a preferred embodiment thereof, it will be apparent to those skilled in the art that the structural details are capable of wide variation without departing from the principles of the invention.

We claim:

1. A portable apparatus particularly adapted for hand carrying skis and ski poles in parallel spaced relationship such that said ski poles may be utilized as a handle to carry said skis, including a relatively rigid body member having a generally flat stem portion and a pole holding clip portion, said pole holding clip portion having a pair of adjacent, resilient ski pole receiving and holding clips disposed near one end of said body member whereby each of said clips is adapted to separately receive and hold a ski pole, said pair of clips maintaining said pair of ski poles in parallel relationship, and an elongated elastic means, said elastic means having one end thereof mounted on said stem portion of said body member, an opposite end of said elastic means being free to allow said elastic means to be looped and stretched around a pair of skis placed in parallel relationship, and generally on opposite sides of said stem portion of said body member, said opposite end of said elastic means having latching means for engaging said body member, said body member having corresponding locking means formed therein for receiving said latching means for engaging said body member to allow said elastic means to be tightly stretched around said skis and securely fastened to said body member under tension to hold said skis adjacent one another and said body member.

2. The ski and ski pole carrying apparatus of claim 1 wherein said stem portion of said body member is generally vertical and integrally formed with said clip portion of said body member, said clip portion having a pair of adjacent, downwardly-opening, resilient, clips disposed near an upper end of said body member generally on opposite sides of a central vertical axis through said body member, said clips being formed to receive and hold said ski poles.

3. The ski and ski pole carrying apparatus of claim 2 wherein said resilient clips are generally C-shaped and a first one of said adjacent clips has an interior diameter generally corresponding to a diameter of a handle end of a ski pole and a second one of said adjacent clips has an interior diameter generally corresponding to the interior diameter of a tip end of a ski pole, each of said clips having a mouth formed with a slightly reduced diameter to thereby receive and hold said ski poles within said clips.

4. The ski and ski pole carrying apparatus of claim 2 wherein each of said resilient clips are generally C-shaped and each of said clips has an interior diameter generally corresponding to the diameter of said ski poles and a mouth formed with a slightly reduced diameter to thereby receive and hold said ski poles.

5. The ski and ski pole carrying apparatus of claim 1 wherein said stem portion of said body member includes horizontal slot means formed therein to receive said one end of said elastic means therethrough to thereby maintain said one end of said elastic means therein when said elastic means is stretched around said axis under tension.

6. The ski and ski pole carrying apparatus of claim 5 wherein said elastic means has a nib formed near said one end thereof which may be forcibly inserted with said one end through said slot means formed in said stem portion of said body member to thereby mount said one end of said elastic means on said body member.

7. The ski and ski pole carrying apparatus of claim 5 wherein said slot means includes a pair of spaced parallel slots formed in said body member through which said one end of said elastic means may be adjustably threaded and thereby mounted on said body member.

8. The ski and ski pole carrying apparatus of claim 1 wherein said latching means for engaging said body member associated with said opposite, free end of said elastic means includes a locking key adjustably mounted near said opposite end of said elastic means, and said locking means formed in said body member includes a correspondingly-shaped locking opening formed in said stem portion of said body member, said locking key engaging said locking opening to thereby secure said opposite end of said elastic means to said body member.

9. The ski and ski pole carrying apparatus of claim 8 wherein said locking key includes a mounting portion having a pair of spaced parallel slots through which said opposite end of said elastic means may be adjustably threaded and secured thereto, and a T-shaped tab portion, said locking opening being formed in a generally T shape corresponding to said locking tab and receiving said locking tab therethrough to secure said opposite end of said elastic means to said body member.

10. The ski and ski pole carrying apparatus of claim 9 wherein said tab portion of said locking key and said mounting portion of said locking key are disposed at an angle relative to one another such that when said tab portion engages said locking opening formed in said body member and a tensile force is exerted on said elastic means, said opposite end of said elastic means mounted on said mounting portion will be disposed approximately adjacent said one end of said elastic means mounted on said body member.

11. The ski and ski pole carrying apparatus of claim 1 wherein said latching means for engaging said body member associated with said opposite end of said elastic means includes a series of spaced openings formed along said elastic means near said opposite end thereof, and said locking means on said body member includes a locking boss formed in an opening in said body member, a selected one of said openings formed in said elastic means being received over said locking boss to thereby secure said opposite end of said elastic means to said body member.

12. The ski and ski pole carrying apparatus of claim 1 wherein said latching means for engaging said body member includes a series of outwardly-extending ribs formed in spaced relationship along said opposite, free end of said elastic means, and said locking means on said body member includes a locking opening of lesser dimension than the dimension of said ribs formed in said stem portion of said body member, a selected pair of said ribs being insertable through said locking means to secure said elastic means to said body member.

* * * * *